United States Patent [19]

Sumi

[11] 4,127,366

[45] Nov. 28, 1978

[54] FUEL INJECTION PUMP ASSEMBLY FOR DIESEL ENGINE

[75] Inventor: Shizuo Sumi, Nagoya, Japan

[73] Assignee: Nippondenso Co., Ltd., Kariya, Japan

[21] Appl. No.: 781,005

[22] Filed: Mar. 24, 1977

[30] Foreign Application Priority Data

Mar. 31, 1976 [JP] Japan ..... 51-35603

[51] Int. Cl.[2] ..... F04B 7/04; F04B 39/10

[52] U.S. Cl. ..... 417/494; 417/501; 123/139 BD

[58] Field of Search ..... 417/494, 499, 500, 501; 123/139 AD, 139 BD; 29/156.4 R

[56] References Cited

U.S. PATENT DOCUMENTS

| | | | |
|---|---|---|---|
| Re. 25,873 | 10/1965 | Rutherford | 92/128 |
| 2,410,947 | 11/1946 | Johnson | 417/494 |
| 2,419,542 | 4/1947 | Dreisen et al. | 417/494 |
| 2,871,796 | 3/1959 | Dreisin et al. | 417/494 |
| 3,624,823 | 11/1971 | Staudt et al. | 417/499 |
| 4,023,916 | 5/1977 | Indra | 417/499 |

FOREIGN PATENT DOCUMENTS

| | | | |
|---|---|---|---|
| 240,148 | 8/1962 | Australia | 417/494 |

*Primary Examiner*—Carlton R. Croyle
*Assistant Examiner*—Thomas I. Ross
*Attorney, Agent, or Firm*—Cushman, Darby & Cushman

[57] ABSTRACT

A pump housing has an upwardly opening cylindrical bore and the bottom of the housing is blinded. Pump elements, such as a tappet and upper and lower spring seats, are slidably disposed in the cylindrical bore, wherein each of the outer diameter of the pump elements is made smaller than the inner diameter of the cylindrical bore, so that those pump elements can be assembled in place in the bore from the top of the pump housing.

2 Claims, 8 Drawing Figures

FUEL INJECTION PUMP ASSEMBLY FOR DIESEL ENGINE

BACKGROUND OF THE INVENTION

The present invention relates to a fuel injection pump for a Diesel engine for feeding fuel under pressure to the respective cylinders of the engine.

Recently, in view of air pollution by automobiles pressure of the fuel fed to the engine has been required to be made higher.

In order to increase the fuel pressure, mechanical strength of each element of the fuel pump must be taken into consideration, for example the strength of a cylinder, a pump housing, a cam shaft etc. must be increased. In a conventional fuel injection pump, however, an assembling hole is provided on the pump housing at its bottom for assembling each element of the pump through the hole, and therefore, it is impossible to make the pump housing stronger without enlarging the size thereof.

SUMMARY OF THE INVENTION

It is, therefore, an object of the present invention to overcome the above drawbacks and to provide an improved fuel injection pump having a higher mechanical strength and being capable of feeding fuel under a high pressure to cylinders of a Diesel engine. According to one aspect of the present invention, the fuel injection pump is so constructed that a set of pump elements such as a cylinder, a plunger, a control sleeve, upper and lower spring seats, a spring and so on can be assembled in place in the pump housing from the top portion thereof, whereby the assembling hole required in the conventional pump becomes unnecessary with a result that the pump housing can be made stronger than the conventional one.

It is another object of the present invention to provide an improved fuel injection pump wherein assembling steps for the pump elements are made simpler.

It is a further object of the present invention to provide a fuel injection pump wherein an upper spring seat is easily and effectively fixed in place in the pump housing.

The other features, objects and advantages of the present invention become more apparent in the following detailed description when read in connection with the accompanying drawings.

DETAILED DESCRIPTION OF THE PREFERRED EMBODIMENTS

Figure 1:
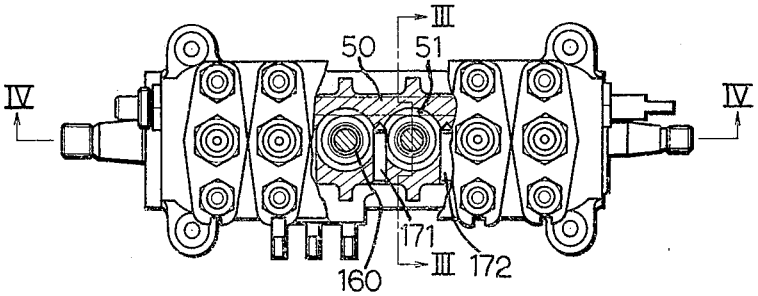
FIG. 1 is a partially sectional top plan view showing a fuel injection pump for a Diesel engine according to the present invention.
Figure 2:
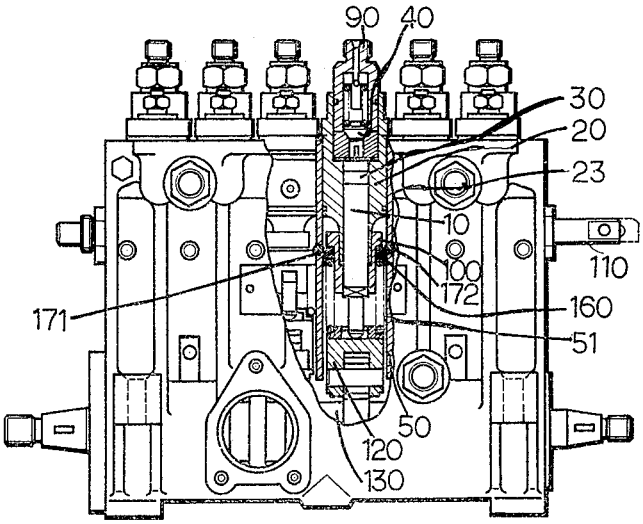
FIG. 2 is a partially sectional and cutaway elevational view showing the fuel injection pump.
Figure 3:
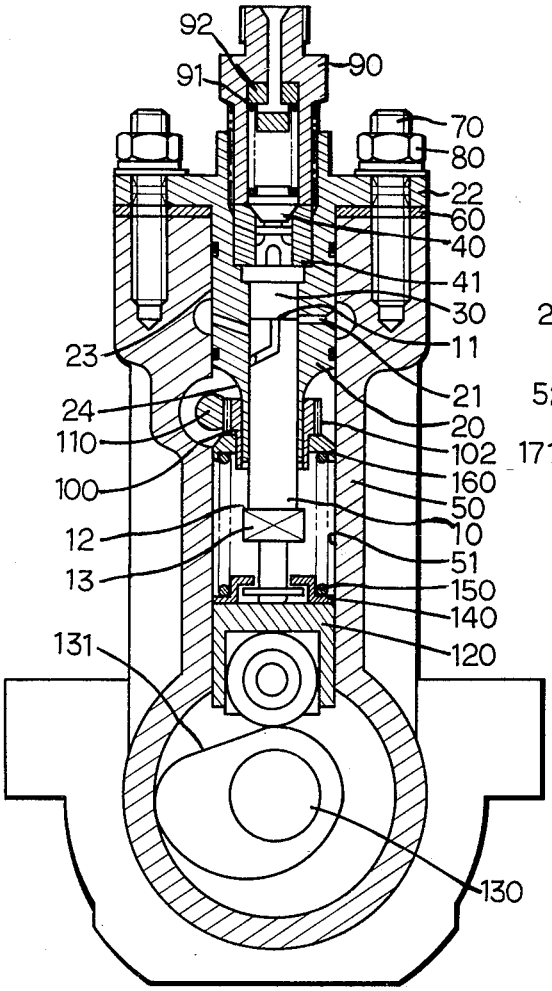
FIG. 3 is an enlarged sectional view taken along line III — III in FIG. 1.

Referring to FIGS. 1 to 4, a plunger 10 is reciprocally disposed in a cylinder 20 to define a pump chamber 30 by an upper surface 11 of the plunger 10. With the downward movement of the plunger 10 fuel from a fuel tank (not shown) is supplied to the pump chamber 30 through a feed hole 21, and the upward movement thereof compresses the fuel therein as in a known manner so that the fuel is supplied under a high pressure to a fuel injection nozzle (not shown) through an opened delivery valve 40. The cylinder 20 is formed with a flanged portion 22 at its upper section, a cylindrical portion 23 at its intermediate section, and a small-diameter cylindrical portion 24 at its lower section.

A pump housing 50 having a flat top surface is provided with a plurality of upwardly opening cylindrical bores 51 terminating at the top surface. The bottom of the housing 50 is blinded. Each cylinder 20 is inserted into the respective bores 51 and is secured at its flanged portion 22 by means of a stud bolt 70 and a nut 80 with a spacer 60 interposed between the top surface of the pump housing 50 and the undersurface of the flanged portion 22. The spacer 60 adjusts with its depth the position of the cylinder 20 with respect to the pump housing 50, that is the longitudinal position of the cylinder 20 with respect to the plunger 10.

The delivery valve 40 is slidably disposed in a valve seat 41 press-fitted into the cylinder 20. A valve holder 90 is also screwed into the cylinder 20 for holding therein a bias spring 91 and a spring stopper 92, so that the delivery valve 40 is normally biased toward the valve seat 41 (namely, in a valve closing direction.) The valve holder 90 is connected to the fuel injection nozzle (not shown) through a likewise not shown fuel feed pipe. The delivery valve 40 is opened to feed the fuel from the pump chamber 30 to the injection nozzle during the compression stroke of the cylinder 20 and serves to quickly reduce the fuel pressure in the fuel feed pipe when the compression stroke terminates.

Figure 4:
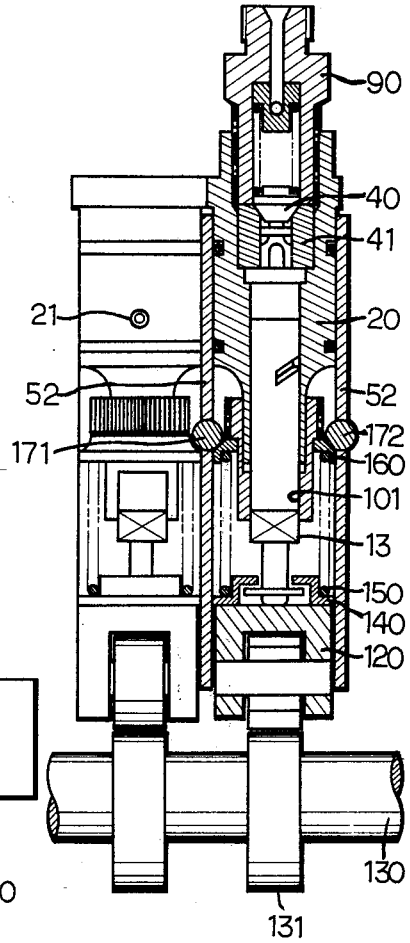
FIG. 4 is an enlarged sectional and cutaway view showing a part of the fuel injection pump in FIG. 1, wherein the sectional part is view taken along IV — IV in FIG. 1, FIGS. 5A and 5B are respectively an enlarged top plan and section views showing an upper spring seat in FIG. 1, and FIGS. 6A and 6B are respectively an enlarged top plan and sectional views showing a modified upper spring seat.

At the lower portion of the plunger 10 is provided a rectangular portion 12 in cross section having parallel surfaces 13, with which inner surfaces 101 of a control sleeve 100 are engaged as best seen in FIG. 4. The control sleeve 100 is rotatably supported on the small-diameter cylindrical portion 24 and is formed with a spur gear 102 at its upper outer surface. The spur gear 102 is engaged with a control rack 110 operatively disposed in the pump housing 50, which is then coupled with a governor (not shown) for driving the control rack 110 in response to an engine speed and so on as in a well-known manner.

The longitudinal movement of the control rack 110 rotates the control sleeve 100 to change the relative position of the control sleeve 100 with respect to the cylinder 20. Since the control sleeve 100 is engaged with the plunger 10 at the rectangular portion 12 thereof, the circumferential relative position of the plunger 10 is also changed with respect to the cylinder 20 so that the quantity of the fuel to be fed to the nozzle is thereby changed in accordance with the longitudinal movement of the control rack 110.

A tappet 120 is slidably disposed in the cylindrical bore 51 of the pump housing 50 for converting a rotational movement of a camshaft 130 into a reciprocating movement and transmitting to the plunger 10. For the purpose, the lower end of the tappet 120 abuts on a camsurface 131 of the camshaft 130. And the outer diameter of the tappet is made equal to or smaller than the inner diameter of the cylindrical bore.

On the tappet 120, a lower spring seat 140 is slidably disposed in the cylindrical bore 51 of the pump housing 50 and biased downwardly by a spring 150 and also engaged with a lower end of the plunger 10 as shown, so that the tappet 120 is always kept in contact with the camsurface 131 and the plunger 10 performs the reciprocal movement in accordance with the rotation of the camshaft 130.

An upper spring seat 160 is likewise slidably disposed in the cylindrical bore 51 of the pump housing 50 for holding the other end of the spring 150 and is engaged with pins 171 and 172 screwed into the pump housing 50 as best shown in FIG. 4, so that the upward movement thereof is thereby restricted. Each of the outer diameters of the lower and upper spring seats 140 and 160 is made equal to or smaller than the inner diameter of the cylindrical bore.

Figure 5A:
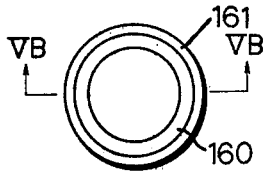
Figure 5B:
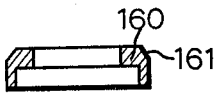

Detailed construction of the upper spring seat 160 is shown in FIGS. 5A and 5B. As noted therefrom, the seat 160 is of a ring form and is formed with an annular beveling 161 at its upper outer periphery, with which the above pins 171 and 172 are engaged.

The diameter of each pin 171, 172 is made a little larger than a width of a wall 52 of the pump housing 50 between adjacent cylindrical bores 51, so that when each of the pins 171 and 172 is screwed (or inserted) into the pump housing 50 in a direction normal to the longitudinal direction of the cylinder 20, a part of each pin 171, 172 protrudes from the wall 52 into the cylindrical bore 51 as best seen in FIG. 4. Thus, the annular beveling 161 of the upper spring seat 160 is engaged with the pins 171 and 172, whereby the upward movement of the seat 160 is restricted.

When each of the above elements is assembled, those elements are assembled in the cylindrical bore 51 of the pump housing from the top thereof in an order of the tappet 120, the lower spring seat 140, the spring 150, the upper spring seat 160, the plunger 10, the control sleeve 100 and the cylinder 20. Therefore, those elements can be removed upwardly from the cylindrical bore 51, wherein when the upper and lower spring seats 160 and 140 and the tappet 120 are upwardly removed the control rack 110 and pins 171 and 172 should be previously taken away from the pump housing 50.

As above, in a case of assembling, dismantling, exchanging or renewing one or more of the above elements, that is the cylinder 20, the plunger 10, the spring seats 140 and 160, the spring 150 or the tappet 120, the camshaft 130 is not necessary to be disassembled from the pump housing 50, whereby the above steps can be carried out with great ease. Further, it is neither necessary to provide such an assembling hole at the bottom of the pump housing 50 as is required in a conventional one, with an advantageous result that the mechanical strength of the pump housing is increased.

As also noted above, the upper end of the spring 150 is held by the upper spring seat 160 which is then engaged with the pins 171 and 172, so that the biasing force of the spring 150 is not applied to the cylinder 20. Especially, when the cylinder 20 and the plunger 10 are removed from the cylindrical bore 51, the removing action therefor can be operated while remaining the lower and upper spring seats 140 and 160, the spring 150 and the tappet 120 in their assembled condition, whereby the removing action can be operated with increased working efficiency.

Figure 6A:
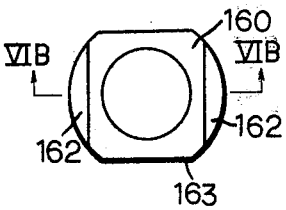
Figure 6B:
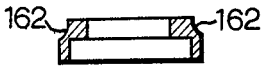

FIGS. 6A and 6B show a modification of the upper spring seat 160, wherein opposite portions of the seat 160 are cut away to form flat sections 163 parallel with each other. The length of the parallel flat sections 163 is so made as to be shorter than the width of the two adjacent pins 171 and 172 which are parallelly inserted into the pump housing 50. Accordingly, the modified upper spring seat 160 according to FIGS. 6A and 6B can be assembled in place in the cylindrical bore 51 of the pump housing, while remaining the pins 171 and 172 held in their normal position in the pump housing 50, in such a manner that the seat 160 is inserted into the cylindrical bore 51 with the parallel flat sections being parallel with the pins 171 and 172. The upper spring seat 160 is also formed with bevelings 162 round in cross-section as clearly shown in FIG. 6B, each of which is straightly extending in parallel with each other. The bevelings 162 are engaged with the pins 171 and 172 so that the upper spring seat 160 is prevented from being rotated with respect to the cylindrical bore 51.

The lower spring seat 140 as well as the tappet 120 can be also made in such a manner that they are formed with parallel flat sections as in the case of the upper spring seat 160 as explained with reference to FIGS. 6A and 6B, whereby they can be assembled in place in the cylindrical bore 51 of the pump housing 50 or removed therefrom while remaining the pins 171 and 172 held in place in the pump housing 50.

It should be also noted that the upper section of the cylindrical bore 51 may be made larger in diameter than that of the lower section thereof and each of the pins 171 and 172 protrudes into the larger cylindrical bore so that the lower spring seat as well as the tappet is likewise assembled in the cylindrical bore with the pins 171 and 172 being held in the pump housing.

What is claimed is:

1. A fuel injection pump for a diesel engine comprising:

a pump housing having an upwardly opening cylindrical bore and a portion rotatably enclosing a cam shaft below said cylindrical bore, the bottom of said pump housing being blinded;

a tappet slidably disposed in said cylindrical bore and abutting at its lower end on the cam surface of said cam shaft;

a cylinder inserted into said cylindrical bore and detachably fixed to said pump housing;

a plunger reciprocally held in said cylinder;

a lower spring seat slidably disposed in said cylindrical bore and mounted on said tappet with said tappet engaging the lower end of said plunger and with the lower end of said plunger being engaged with said lower spring seat;

a spring having a lower end engaged with said lower spring seat for biasing the same downwardly, so that said plunger is also biased downwardly;

an upper spring seat disposed in said cylindrical bore for holding the upper end of said spring;

each of the outer diameters of said tappet and lower and upper spring seats being smaller than the inner diameter of said cylindrical bore; and a pair of pins inserted into said pump housing in parallel with each other, a portion of each of said pins protruding into said cylindrical bore;

said upper spring seat being formed with bevelings for engaging the protruded portions of said pins so that movement thereof away from the said bottom of said housing is restricted by said pins, and said upper spring seat being formed with parallel flat sections, the width thereof being smaller than the distance between said pair of pins.

2. A fuel injection pump according to claim 1, wherein said bevellings of said upper spring seat extend parallel to one another and are straight and located on the upper outer periphery thereof, said bevelings being curved in cross-section each for tangential engagement with a said pin whereby relative movement of said upper spring seat is prevented with respect to said cylinder when a said pin is engaged with a said beveling.

* * * * *